United States Patent [19]

Miller

[11] Patent Number: 4,919,350

[45] Date of Patent: Apr. 24, 1990

[54] HOLDER/DISPENSER FOR PAPER IN ROLL FORM

[76] Inventor: Norman T. Miller, 4201 Burnham, Toledo, Ohio 43612

[21] Appl. No.: 275,948

[22] Filed: Nov. 25, 1988

[51] Int. Cl.[5] ..... A47K 10/32; A47K 10/04

[52] U.S. Cl. ..... 242/55.2; 225/51

[58] Field of Search ..... 242/55.2, 55.53, 55.54; 225/51, 82

[56] References Cited

U.S. PATENT DOCUMENTS

| | | | |
|---|---|---|---|
| 2,905,404 | 9/1959 | Simmons | 242/55.2 |
| 4,058,197 | 11/1977 | West | 242/75.4 X |
| 4,271,962 | 6/1981 | Stepanski | 225/51 X |
| 4,477,037 | 10/1984 | Goldstcih | 242/75.4 |
| 4,634,067 | 1/1987 | White | 242/55.3 X |
| 4,720,053 | 1/1988 | Vance | 242/55.54 |

*Primary Examiner*—Donald Watkins

[57] ABSTRACT

This invention contemplates an improved dispenser of paper in roll form by reason of novel friction brake device which provides user control and economy.

17 Claims, 1 Drawing Sheet

HOLDER/DISPENSER FOR PAPER IN ROLL FORM

The present invention relates to the art of hardware/-houseware's device for holding paper in roll form, and more specifically to convenience devices for storing and dispensing lengths of paper from a supply roll thereof held in such suitable convenience device located proximate the area of use.

Even more specifically the present invention relates to an improvement in a storage/dispenser of paper tissue and to the dispensing thereof in the bathroom, kitchen, washroom, workplace, office or the like.

Supply rolls of such paper formed of a significant length wound on a cylindrical core are most generally carried on a spool or spindle mounted rotatably between a pair of parallel arms carried by a bracket secureable to a vertical wall in the bathroom or kitchen or washroom area. These devices are a convenience in providing a supply of paper which is readily accessable and available to the user where needed. Usually the user simply, with one hand, grasps the free end of the roll of paper containing spaced lines or zones of weakness, pulls a desired length then moves the withdrawn length laterally to separate a desired length on one of the lines or zones of weakness, at or near the roll itself.

Unfortunately the pulling of a length of the paper roll frequently results in unreeling more than needed or desired. The undesired length is rerolled onto the supply roll only with difficulty and thus usually this practice is not followed; with the result that the unnecessary length is discarded leading to wasted paper and to housecleaning headaches when the unused lengths are discarded on the floor.

Equally and sometimes more important, the effort taken to rip/separate the desired length is just not successful, in that the tear separation is not accomplished and the user/consumer must take further action such as use of the other hand in order to effect the separation at all.

Frequently the rolls are carried on the spool or spindle so loosely that removal of a length is accomplished only with further additional effort and manipulation and withdrawal of an unnecessary amount is more the rule rather than the exception. Additionally the spools and/or spindles are frequently rotatable in the arms which accentuates the problems of failure and as well wasted paper and accumulated discarded lengths on the floor of the public washroom or similar area.

The waste resulting from withdrawing excess paper, and, as well, the usual resulting unsightlessness due to users discarding the same on the floor of the washroom or the like, adds to the cost of maintenance of public, institutional, corporate or government washrooms and is therefore very undesireable.

Several patents have issued on paper roll holders of various constructions. One such patent, U.S. Pat. No. 2,632,606, discloses a stop lug for the inner end of a paper roll and is said to prevent undue rotation of the roll.

Another U.S. Pat. No. 2,392,996, discloses a combination of webs for frictional engagement with the core of a paper roll to allegedly resist rotation.

Another U.S. Pat. No. 1,109,929, discloses a cone-shaped, spring-loaded shaft precluding withdrawing more than a single sheet.

Still another U.S. Pat. No. 840,651 (1907) discloses a brake ring and wing nuts/screw construction to adjust pressure and effect unwinding.

Additionally U.S. Pat. Nos. 3,438,589 and 4,179,077 disclose holder structures for paper rolls.

The structures disclosed in the various patents are, however, not seen in the market place, probably because of the complicated nature of the internal mechanism which are necessarily expensive, cumbersome and ill-suited for true convenience, changeability, ease of use, and speed of roll replacement, as to lend themselves to practical adoption and usage. None of the structures disclosed in the above patents in any way compare with the utility, simplicity, economy, and trouble free character implicit in the construction, in accordance with the present invention, as will be evident and manifest from the detailed description of the present invention, the explanation, and including drawings, to follow.

It is, accordingly, a principal object of the present invention to provide a simple and novel improvement in roll holder devices which effectively addresses the problem of lack of control and excessive withdrawal of paper from a roll, and at the same time effectively eliminates the problems normally attendant withdrawal of unnecessary amounts of paper from the typical roll holder.

It is yet another object of the invention to provide such an improvement which enables sure, effective, simple and reliable control of the removal of a length of paper of desired length quickly and without necessity of additional effort and manipulation.

It is another object of the present invention to provide a modified structure in which said modification is totally independant of parts and sub elements of any of a variety of holders for roll paper presently on the market.

It is still another object of the present invention to provide a modification which is so simple and inexpensive/economical as to strain credulity.

It is still further object of the present invention to provide a modification which may be utilized by manufactures or suppliers of paper roll holders or the makers and suppliers of paper in roll form.

It is a further object of the present invention to provide a kit consisting of an element and instructions for attaching said element of particular construction, arrangement and/or composition as will adapt it for securement to a paper roll holder in such a manner as will impart to said paper roll holder, the appropriate braking function opposing uninhibited withdrawal of paper from the roll carried rotatably in the holder, and thus allow positive user control of the amount of paper corresponding to that actually desired and with a degree of specificity beyond that possible heretofore.

It is additionally an object of the present invention to provide a plurality of combinations of the element, as set forth in the previous paragraph, with a roll holder or with packages of rolls of the paper, and which thereby enhances the desireability and saleability of either the holder device or the package of a roll or rolls of paper by reason of the function, character and attribute which the element lends to the utilization of the holder or the roll or the package of a roll or rolls of paper, beyond that of the one or the other alone and without the element.

The foregoing, and as well other objects of the present invention, will become apparent to those skilled in the art from the following more detailed description taken in conjunction with the annexed sheet of drawings, on which are presented illustrations of several embodiments of the present invention.

In its simplest embodiment, the present invention comprises a modification of one or both of the facing surfaces of the arms or legs of a typical holder for a roll of paper and consequently positioned for physical contact with the edges of the paper wound upon itself, and, due to its surface characteristic, serving to brace free rotation sufficient to resist the tearing force or torque imparted to a length of paper transverse to the axis of withdrawal, urging thereby movement of the entire roll laterally on the spool to bring the edges, in overlapped array, against the facing surface of one arm or the other to initiate frictional abutment, sufficient that the lateral tearing force will cause a severing of the paper on one or the other of several spaced parallel lines of weakness inherent in the paper carried on the roll in wound fashion.

Thus the present invention provides a positive control means for unfailing separation removal of a length of paper rather than random success associated with the roll holders not modified in accordance with the present invention.

Figure 1:
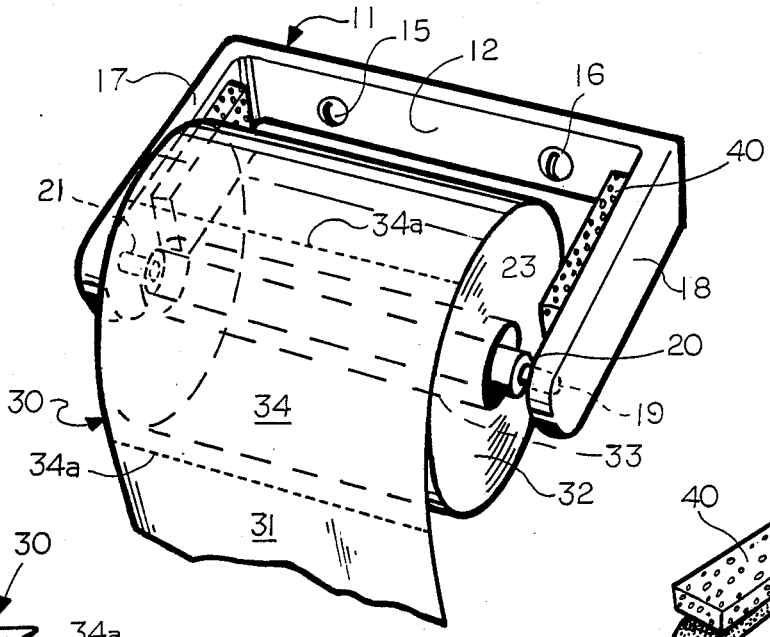
FIG. 1 is a perspective view of a roll of paper carried in a suitable holder, modified, in accordance with the present invention to include a braking element.

Referring now more specifically to the drawings; there is disclosed, in FIG. 1, a holder device 11 for holding a roll of paper 30, formed of a length of paper wound upon a cylindrical cardboard core 33, in repeated overlapping courses or winds 32 terminating in a final free end 31 hanging vertically downwardly as shown and available to be grasped by thumb and finger of user, thence pulled downwardly to unreel desired length, then moved left of right to tear separate desired length on line of weakness.

The holder 11 includes a generally rectangular, elongate base 12, provided with a pair of wood screws 15, 16 serving for threaded engagement with a vertical wall not shown and fastening the base 12 thereto in secure fashion and in the desired position accessible for use. A pair of arms 17 and 18 integrally connected to the ends of the base 12 extend perpendicularly outwardly from the base. Arm 18 includes a bearing recess 19 as does the arm 17 (although not shown) which are in opposed registration to receive terminal end pinions 20 and 21 extending from opposite ends of a spool 23. Although not fully shown, it will be appreciated that the spool is axially segmented and spring loaded internally to allow the spool assembly to be compressed and shortened axially in order that the spindle may be removed from the bearing, at one end or the other so that the cardboard core 33 may be removed when all of the paper is depleted, and, of course, to allow mounting/positioning of a new fresh roll of the paper.

The reference numeral 30 identifies a roll of paper composed of a significant length of said paper wound upon a cylindrical cardboard core 33 and upon itself terminating in a free end 31 and otherwise divided into panels 34 defined between spaced lines of weakness **34*a* impressed during or after the manufacture of the paper, by a line of perforations or suitable treatment to create said lines of weakness, the latter to serve as a convenience in separating any given length from the total length of paper wound to form the roll 30**.

While the supply length of paper is secured at its inner end to the outer surface of the cardboard cylinder 33; the latter (cardboard cylinder) is of sufficient and ample inside diameter as to clearly exceed that of the outside diameter of the spool 23 and thus is freely moveable and rotatable, as, for example, upon a pulling force exerted on the free end of the length of paper for the purpose of unreeling a particular length. Additionally the pinion ends of the spool are loosely supported in the bearing recesses in the arms, so that the spool itself as freely rotatable with no inhibition of the free unreeling of a length of paper responsive to a hand or hand/finger pull which is away from and normal or perpendicular to the axis of the spool and the axis of the roll of paper.

It will be understood that free rotation is desired so that the unreeling occurs very freely and without hindrance, as might otherwise sufficiently oppose the pull of the user and create a force of opposition sufficient to cause an undersired premature severing/separation on one of the spaced lines of weakness disposed transversely across the length of paper in repeating spaced relationship for convenience in allowing separation of a desired length. Unfortunately, as indicated earlier herein, the free rotation, both of the cardboard cylinder on the spool and the spool in the arm member bearing recesses, frequently results in the users applying a given pull which unreels more than the length desired, resulting in a loop extending from the mounted roll to the floor or to a sufficient distance below the roll that single handed transverse force is useless due to failure to be translated to the line of weakness and cause a severing of any length.

Frequently the user attempts to hand turn the roll in a rewinding movement in order that a proper tearing separation can occur. This effort however is usually unsuccessful and in any event results in a bulky appearing roll which is undesired and suspicious leading to user dissatisfaction.

Even if, an unnecessary length is not unreeled, due to pulling force; attempts to sever and remove a given length by a sudden lateral motion to initiate fracture along one lateral edge, or the other, approximate the line of weakness, is unsuccessful and due to its suddenness and magnitude usually results in failure to separate and the subsequent sudden withdrawal of an undetermined, uncontrolled length of paper leading to the scenario described just previously.

In either case, the resulting unwanted amount of paper is found to be not only wasteful, but creates a disposal problem which is aggravating and frequently ends in unsightly excess lengths of paper on the floor and the surrounding area, creating not only a housecleaning problem but a fire safety hazard, or personal safety due to the possibility of slipping on the paper interfacing with a waxed floor, etc., etc.

In keeping with the objects of the present invention as set forth hereinabove, and to address the problems, the dissatisfaction and other manifestations and results in inherent with paper roll holder/dispenser devices known heretofore in the art; the modifications, in accordance with the present invention, offers a solution and improvement which is unique, yet simple, in providing a brake control by the expedient of modifying the facing surfaces of the arm portions of the conventional paper roll holder.

In its simplest form, the present invention provides for attachment to the inner facing surfaces, 17*a* and 18*a*, , of legs 17 and 18; a length of material having a composition and/or surface characteristic which frictionally (as opposed to smoothly) contacts the annular surface of the roll of paper, (which in turn is composed of the wound-upon-itself spiral-defining edge of the endless length of paper) responsive to appropriate manipulation by the consumer/user.

It has been found most desireable that the length of the element 40 should approximately correspond to the radius of the full roll of paper, and as well the radius of the essentially depleted roll. This length is illustrated diagramatically in the drawings relative to the other components. Generally the thickness of the element 40 may vary but should be at least sufficiently thick that the element will exhibit some degree of resilience or ability to deflect when contacted by the annular side of the roll. At the same the thickness, but should leave a space between the surface of the element and the roll as will provide a clearance on either side permitting free withdrawal (or removal) which is not hindered by frictional contact between the element and the roll as would prematurely cause the braking by frictional contact of the roll and element 40.

It has been found that a relatively resilient material composed of a plurality or multiplicity of sub or mini elements, of which two examples, include the surface created by cutting a cellular foam and discrete fingers.

The cut surface of a piece of cellular foam, upon inspection, reveals a large plurality of cut edges of random directional orientation. The size of the cell will be determinative of the number of edges in a given section of the element. The number of edges (dependent upon the size of the cell) and the resilient, flexible nature of the material cooperate to exert frictional and braking resistance to the annular surface of the roll, as it otherwise rotates on the spool and also on the pinions in the arm-bearing recesses.

The fingers referred to above are probably best represented by bristles of a brush. A workable example comprises bristles like those of a tooth brush. Close examination thereof reveals a multiplicity of elements (rather than a multiplicity of edges) and at the same time a resilient nature due to the deflection of the individual bristles, (or the bristles in aggregate) as they come into surface, frictional contact with the annular surface of the roll, composed of itself of multiple spiral of winds with a continuous length of paper as aforesaid.

Figure 2:
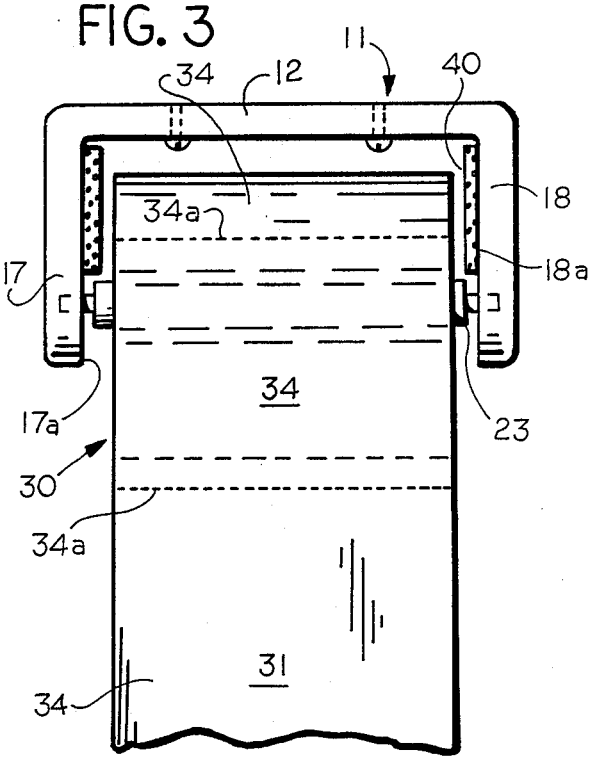
FIG. 2 is a top plan view of the holder, and serving to illustrate more clearly the nature of the positioning of the parts of the modification in accordance with the present invention.
Figure 4:
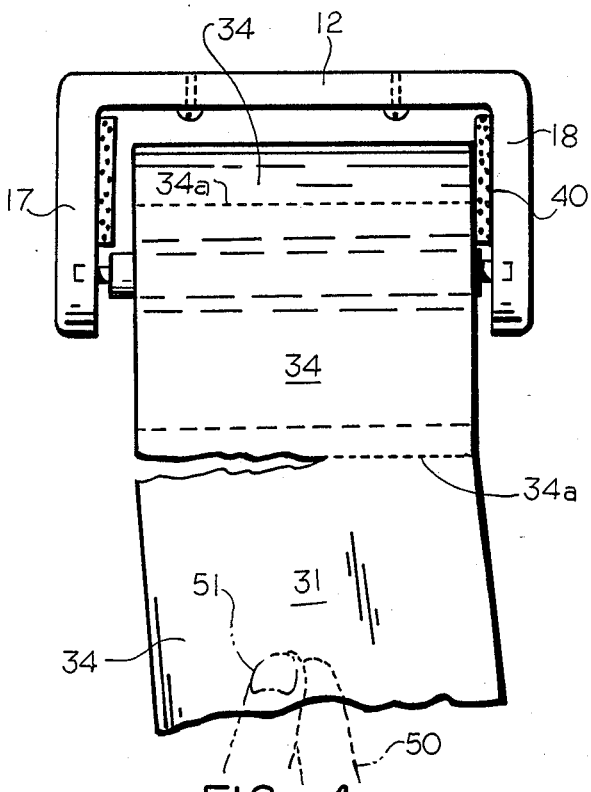
FIG. 4 is a plan view like FIG. 2, for the purpose of showing, severing of a selected length of paper and the functioning of the modification in accordance with the present invention.

At this juncture reference is directed to FIG. 4 which illustrates the operative feature of the present invention. Generally FIG. 4 is like FIG. 2, in its illustration of the same elements identified by the same reference numerals. It will be seen however, that opposed fingers 50 and 51 grasp or pinch the free end 34*a* of the length of paper and urge that free end positively to the right. By reason of the freedom of rotation and movement of the roll of paper on the spool 23; this action has moved the entire roll over to the right, so that the annular surface of the roll has come into contact with the surface of the length of resilient cellular foam 40 whereby the coefficient of friction between the element 40 and said surface serves to brake rotation of the roll and simultaneous initiation and propagation of a severing/tearing of the lengths of paper on the line of weakness 34*a*. This effectively separates the desired length of paper from the remainder of the roll. The braking action and the initiation, propagation and completion of the tear on the line of weakness is assured, is positive and is under the control of the individual user who accomplishes the purpose simply and predictably.

The operation as above described is achieved by an individual using only one hand (or pair of fingers) and does not require a second hand to manually brake and/or hold the roll in order to achieve the separation. Furthermore with the length of resilient cellular foam, or suitable equivalent, located on each of the inside facing surfaces of the arms 17 and 18; it makes no difference whether the initiating grasp and movement laterally proceeds to the right or the left. It can thus be seen that the preferred embodiment of the present invention possesses a universality which is most desirable considering the variety of mounting positions for the roll holder that may be encountered for particular installations, room size, room or stall configurations, wall placement; all with respect to the bodily position of the consumer/user.

Figure 3:
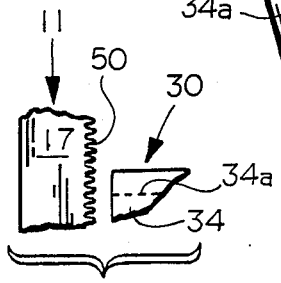
FIG. 3 is an enlargement of the element 17 portion in FIG. 2, for the purpose of illustrating a variant embodiment of the present invention.

Reference to FIG. 3 illustrates a variant embodiment of the present invention. FIG. 3 is a portion of FIG. 2 in order to show, somewhat enlarged, the arm 17 having a surface 50*a* which is integral with the arm but which has been formed (or in the forming thereof such surface has been modified) to include a structure which exhibits significant frictional engagement with the roll of paper responsive to a slight pulling withdrawal exerted on the free end coupled with a tearing motion to the left (looking at FIG. 3) which causes the roll to slide to the left on the spindle by reason of the free unhindered movement of the roll/core on the spool or spindle 23. The frictional engagement will, coupled with the pulling force, overcome the integrity of the line of weakness initiating a severing which is thereafter propagated along its entire length to sever the desired length of paper from the remainder of the spirally wound length of paper. The surface 50*a* may exhibit the character of a resilient cellular foam by including a suitable blowing agent in the portion of the arm during the molding of the holder 11, formed of a plastic or polymeric material. Alternatively the mold surface may be so configurated that there are formed a plurality of bristle like elements serving as the surface 50, in the manner described earlier herein.

Figure 5:
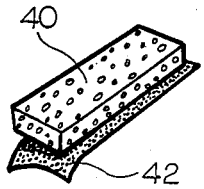
FIG. 5 is a perspective view of one of the elements shown in FIG. 2, said view illustrating a variant embodiment in accordance with the precepts of the present invention.

Reference to FIG. 5 finds an illustration of a variant embodiment, wherein the length of resilient material has adhesively secured to one surface a peel strip 42 which can be manually removed to reveal an adhesive surface on the underside of the element 40 as illustrated. This adhesive surface can serve as the means for attachment for the element 40 to the inner facing surfaces of the arms 17 and 18. Alternatively, in place of the peel strip 42, the underside of the element 40, as shown, may be coated with an adhesive which dries to a nonadhesive character under ambient conditions but may be reactivated to an adhesive character by the application of moisture, much as in the case of postage stamps.

From the foregoing description, it will be appreciated that the present invention provides an extremely simple and economical solution to the problems enumerated above, respecting the usually troublesome and uncontrolled withdrawal of paper from a roll supply thereof.

It is additionally contemplated that the use of a length of resilient, cellular foam or, a suitable equivalent, is easily and readily incorporated into presently existing holders serving as a reservoir/dispenser of the paper, whether it be in the field of housewares, or in office or industrial applications, wherein the storage and dispensing of paper from rolls is found extensively.

Furthermore the simplicity and economy of the present invention ideally lends itself to marketing and sales enhancement of either the holder/dispenser of the paper roll, or of the paper roll material itself, in the form of a package containing one or a plurality of such rolls.

In either case, lengths, of the resilient cellular foam, or suitable equivalent, can be included in the package of the holder or the package containing rolls of paper itself, together with printed instructions for use of the length of the resilient cellular foam on the facing surfaces of the holder arms. The inclusion of the several lengths in a package can, of course, be publicized by suitable language or symbols visible to the likely purchasers and thereby elicit the interest of the purchaser in obtaining a premium for the purchase of either the holder of the roll or the rolls of paper. The premium, of course, resides in the inclusion of the several lengths of resilient cellular foam, or suitable equivilent, together with instructions extolling the economy and control that may be achieved by the buyers/consumers purchase of a particular product of a particular manufacturer which includes the premium and the instructions for securement and use leading to the control provided and the savings to be enjoyed by use of the invention.

It is accordingly clear that the present invention envisions the combination of the braking member such as a one or several lengths of resilient cellular foam, or suitable equivalent, one or more holders (spool type), as a package plus printed instructions for adapting the brake member to the holder, and/or the combination of the braking member and one or more rolls of paper as a package including printed instructions for adapting the brake member to the holder in which the rolls are to b carried.

From all of the foregoing it will be appreciated that the present invention contemplates a number of substitutes, modifications and obvious changes, which are all intended to be included within the spirit and scope of the appended claims, unless such would o violence to the language of the appended claims.

I claim:

1. In combination:

(1) a bracket/reservoir for a roll of paper, including, wall mounting means, a connected pair of parallel arms having facing surfaces and a freely rotatable spool, adapted to carry said roll of paper, carried by and between said arms, (2) a supply roll of paper, having spaced lines of weakness, spiral wound upon itself to form said supply roll and having a central cylindrical passageway telescopically and loosely surrounding said spool, and (3) means constructed and arranged on at least one of said facing surfaces, proximate the spiral edges of said paper in roll form, for frictional contact with said roll to resist rotation sufficient to overcome integrity of said line of weakness.

2. The combination as claimed in claim 1 wherein said combination includes said means on each of said facing surfaces of said arms.

3. The combination claimed in claim 1 wherein said means is a length of a resilient, cellular material

4. The combination as claimed in claim 3 wherein said length of resilient cellular material is adhesively secured to said arm.

5. The combination as claimed in claim 1 wherein said means comprises a multiplicity of bristle-like elements.

6. The combination as claimed in claim 3 wherein said length includes a surface bearing an adhesive for attachment to one of said arms.

7. The combination as claimed in claim 6 wherein said adhesive surface is covered with a protective cover which is strippable/removeable to expose said adhesive.

8. The combination as claimed in claim 7 wherein said adhesive is dry at ambient conditions but water activated to a state of adhesiveness.

9. The combination as claimed in claim 6 wherein said length of resilient cellular material is composed of surface means integral with one of said parallel arms, and being constructed and arranged for abutting braking contact with the edges of said roll responsive to lateral manipulation of free end of said length of paper carried by said spool whereby tear separation occurs at one of said lines of weakness.

10. The combination as claimed in claim 2 wherein said means on each of said facing surfaces in a length of a resilient, cellular material.

11. The combination as claimed in claim 2 wherein said means on each of said facing surfaces comprises a multiplicity of bristle like elements.

12. The combination as claimed in claims 10 or 11 wherein said means are adhesively secured to said arms.

13. The combination as claimed in claim 10 or 11, wherein said means include a surface, bearing adhesive for attachment to said arms.

14. The combination as claimed in claim 13, wherein said adhesive surface is covered with a protective cover which is stripable/removeable to expose said adhesive.

15. The combination as claimed in claim 14, wherein said adhesive is dry under ambient conditions but water activated to a state of adhesiveness.

16. The combination as claimed in claim 1, wherein the means (3) and the spiral edges of said paper in roll from define a clearance, whereby frictional contact occurs responsive to lateral manipulation of the free end of a length of paper carried by said spool.

17. In the combination of a bracket for a roll of paper which includes wall mounting means, a connected pair of parallel arms having facing services and a freely rotatable spool adapted to carry said roll of paper carried by and between said arms;

the improvement wherein at least one of said facing surfaces, generally proximate the spiral wound edges of said paper in roll form, includes means providing for purposeful frictional contact with said roll upon lateral movement of said roll as urged by the users manipulation of free end of said paper.

* * * * *